US008565588B2

(12) United States Patent
Bierbaumer et al.

(10) Patent No.: US 8,565,588 B2
(45) Date of Patent: Oct. 22, 2013

(54) HEAT GENERATOR

(75) Inventors: Hans-Peter Bierbaumer, Kremsmünster (AT); Philipp Michaylovich Kanarev, Krasnodar (RU)

(73) Assignee: Hans-Peter Bierbaumer, Kremsmünster (DE)

( * ) Notice: Subject to any disclaimer, the term of this patent is extended or adjusted under 35 U.S.C. 154(b) by 1162 days.

(21) Appl. No.: 11/918,536

(22) PCT Filed: Apr. 15, 2005

(86) PCT No.: PCT/AT2005/000131

§ 371 (c)(1),
(2), (4) Date: Jun. 17, 2009

(87) PCT Pub. No.: WO2006/108198

PCT Pub. Date: Oct. 19, 2006

(65) Prior Publication Data

US 2009/0263113 A1 Oct. 22, 2009

(51) Int. Cl.
*H05B 3/60* (2006.01)

(52) U.S. Cl.
USPC ..... 392/311; 392/317; 392/320; 392/466

(58) Field of Classification Search
None
See application file for complete search history.

(56) References Cited

U.S. PATENT DOCUMENTS

| | | | | |
|---|---|---|---|---|
| 3,315,681 A | | 4/1967 | Poppendiek | |
| 3,666,917 A | * | 5/1972 | Oglesby | 392/311 |
| 3,983,359 A | * | 9/1976 | Walker et al. | 392/318 |
| 4,613,779 A | | 9/1986 | Meyer | |
| 4,626,699 A | * | 12/1986 | Oesterle et al. | 307/106 |
| 5,058,192 A | * | 10/1991 | Miyahara | 392/311 |
| 5,380,965 A | * | 1/1995 | Moller | 200/11 R |
| 5,440,667 A | * | 8/1995 | Simpson et al. | 392/314 |
| 5,506,391 A | * | 4/1996 | Burayez et al. | 219/772 |
| 6,130,990 A | * | 10/2000 | Herrick et al. | 392/321 |
| 6,522,834 B1 | * | 2/2003 | Herrick et al. | 392/311 |
| 6,678,470 B1 | * | 1/2004 | Hoshino | 392/322 |
| 7,085,483 B2 | * | 8/2006 | Terashima et al. | 392/485 |
| 7,190,886 B2 | * | 3/2007 | Dubicki et al. | 392/326 |
| 7,327,951 B2 | * | 2/2008 | Chaput | 392/493 |
| 7,403,701 B2 | * | 7/2008 | Choi et al. | 392/316 |

(Continued)

FOREIGN PATENT DOCUMENTS

| | | |
|---|---|---|
| CH | 658 507 | 11/1986 |
| JP | 2-122127 | 5/1990 |

(Continued)

OTHER PUBLICATIONS

International Search Report.
English translation of the International Preliminary Report on Patentability.

*Primary Examiner* — Thor Campbell
(74) *Attorney, Agent, or Firm* — Collard & Roe, P.C.

(57) ABSTRACT

The invention relates to a method of heating a fluid (9) containing dipolar particles, such as molecules or clusters of molecules, whereby the fluid (9) is subjected to an electric field in a heat generator (1) causing its particles to be oriented according to their charge. Voltage pulses are applied to the particles, as a result of which their short-range order is destroyed, after which the short-range order can be re-combined during pulse pauses or externally to the heat generator (1), thereby releasing or generating thermal energy.

50 Claims, 3 Drawing Sheets

(56) References Cited

U.S. PATENT DOCUMENTS

Figure 1:
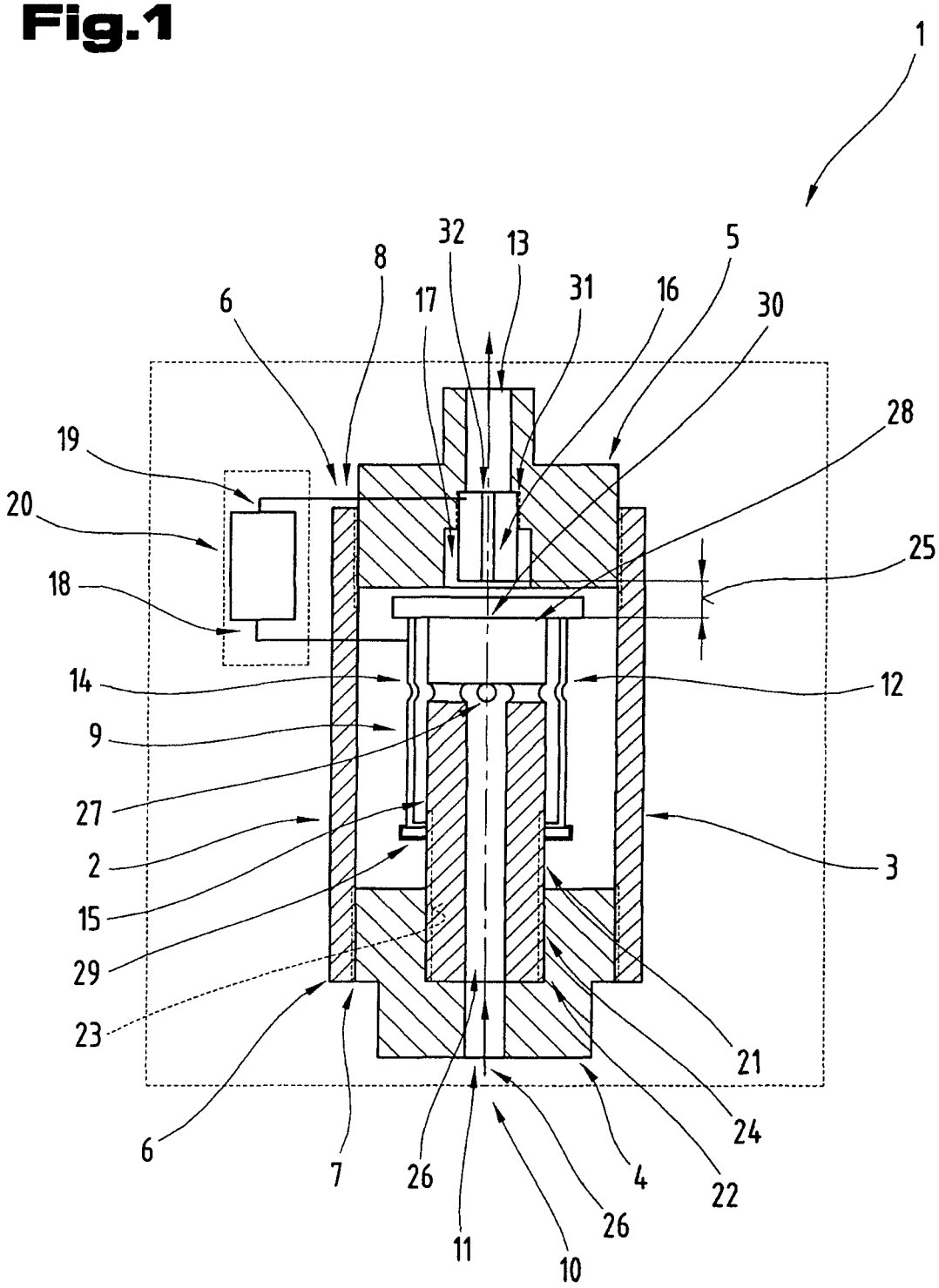

| | | | | |
|---|---|---|---|---|
| 7,817,906 | B2 * | 10/2010 | Callahan et al. | 392/331 |
| 2003/0095584 | A1 * | 5/2003 | Ravnkilde et al. | 375/131 |
| 2009/0068639 | A1 | 3/2009 | Aizawa et al. | |
| 2009/0260959 | A1 * | 10/2009 | Andreasen et al. | 200/11 R |
| 2011/0194845 | A1 * | 8/2011 | Wang et al. | 392/468 |
| 2011/0194846 | A1 * | 8/2011 | Wang et al. | 392/482 |

FOREIGN PATENT DOCUMENTS

| | | |
|---|---|---|
| JP | 32-13970 | 10/2001 |
| JP | 42-13923 | 3/2004 |
| RU | 21 57 861 | 10/2000 |

* cited by examiner

HEAT GENERATOR

CROSS REFERENCE TO RELATED APPLICATIONS

This application is the National Stage of PCT/AT2005/000131 filed on Apr. 15, 2005. The international application under PCT article 21(2) was not published in English.

The invention relates to a method of heating a fluid containing dipolar particles, such as molecules or clusters of molecules, whereby the fluid is exposed to an electric field in a heat generator causing its particles to be oriented according to their charge accordingly, a heat generator for heating a fluid with a housing made from a dielectric material, comprising a housing casing, a housing base and a housing cover, with at least one inlet orifice and at least one outlet orifice for the fluid, and at least one anode and at least one cathode are disposed at a distance apart from one another in the housing, a heating system comprising at least one conveying device for a first fluid, at least one heat generator for heating the fluid, at least one heat exchanger in which heat generated by the fluid is transmitted to another fluid, as well as the use of the heat generator for heating a building.

Methods of heating by electricity are already known from the prior art. They may be sub-divided into resistance heating systems, arc heating systems, induction heating systems, dielectric heating systems, electron heating systems, laser heating systems and combination heating systems. For example, patent specification RU 21 57 861 C discloses a heating system for producing thermal energy, hydrogen and oxygen, which is based on physical-chemical technology. This device comprises a housing made from a dielectric material, which is provided with an integrally cast, cylindrically conical cam with an end-to-end orifice, which forms the anode and cathode chamber in conjunction with the housing. The anode is provided in the form of a flat ring with orifices, sits in the anode chamber and is connected to the positive pole of the supply source. The rod-shaped cathode is made from a heat-resistant material and is fitted in a dielectric, externally threaded bar, by means of which it can be placed in the intermediate electrode chamber, centered in the cover orifice due to a threaded orifice in the housing, and connected to the negative pole of the supply source. The inlet connector for the working solution is disposed in the central part of the anode chamber.

The disadvantages of the methods and devices known to date as a means of heating solid bodies, liquids and gases resides in the high energy intensity of the heating process. Above all, this results in a poor level of efficiency. In other words, a very large amount of electrical energy has to be used for heating purposes, without the benefit of a corresponding conversion into thermal energy, which means that there is a corresponding loss of power. Moreover, these existing methods and devices have fully exhausted all possibilities of reducing the energy they consume in order to heat water and other heat-carrying substances.

Accordingly, the underlying objective of the invention is to propose an improved method of generating thermal energy and a heat generator suitable for this purpose.

This objective is achieved by the invention using the method of heating a fluid outlined above, whereby the particles are subjected to voltage pulses which destroys their short-range order, after which the short-range order can be re-combined during pulse pauses or externally to the heat generator, thereby generating thermal energy, and is also achieved independently by the heat generator, whereby the at least one anode and the at least one cathode are respectively electrically connected to a pole of at least one pulse generator, and is also independently achieved by a heating system incorporating at least one heat generator as proposed by the invention. The advantage of this approach is that the fluid is not heated by alternating current or direct current but by means of voltage pulses. This reduces the energy consumption needed to break down the short-range order of the particles, for example of dipole-dipole interactions or chemical bonds, as a result of which the energy take-up from a primary voltage source can be reduced, thereby increasing the level of efficiency of the heat generator.

The voltage pulses may be generated with a steep rising flank, and in particular at least approximately rectangular pulses are used, as a result of which the short-range order is broken down very rapidly, thereby resulting in lower energy losses than would otherwise occur under some circumstances due to the breakdown of input energy in the form of vibration energy.

In order to make the method mechanically less harsh for the heat generator and the heating system, it is also possible to apply at least approximately triangular pulses to the fluid so that the energy density in the fluid increases more slowly than if using rectangular pulses and the breakdown occurs on a less "explosive" basis. However, it is nevertheless of advantage to select a relatively steep rising flank, i.e. an angle of the rising flank with respect to the base 3 should be greater than 45°.

In one embodiment, voltage pulses with a flat falling edge, at least in the bottom third, are used, thereby enabling a slowly falling voltage curve, which not only facilitates the re-combination or re-organization of the particles but also enables the stress to which the components of the heat generator are subjected to be reduced so that it can be operated for longer periods at least more or less free of maintenance.

In this respect, it is also of advantage if the particles of the fluid are displaced in a resonance vibration, in other words an essentially standing wave is generated within the flow circuit, thereby enabling the energy consumption needed to destroy the short-range order or bonds within molecules to be reduced even further because, as a result, these particles already assume a higher basic vibration in a known manner, in addition to their natural intrinsic vibration, which means that the short-range order merely has to be broken down in the field between the anode and cathode.

Water is advantageously used as the fluid because in the event of failure, any detrimental effect on the environment is kept to a minimum. Moreover, because of the numerous different tetrahedral patterns, in other words the short-range order of the individual water molecules, a very broad spectrum is available for adapting the thermal energy obtained at the respective consumers.

In this respect, it is of advantage if the water is displaced with a base, in particular caustic soda, caustic potash, calcium hydroxide, calcium carbonate, and in another embodiment, a pH value can be set, which is selected from a range with a lower limit of 7.1 and an upper limit of 14 or with a lower limit of 9 and an upper limit of 12, since this measure will render the water more reactive and thus facilitate the break-down of the short-range order or bonds of the water molecules and thus enable energy consumption from the primary source to be reduced.

Another option is to arrange the particles of the fluid in a specific order with the aid of an energy radiating system before they enter the heat generator, thereby enabling energy consumption in the electric field between the anode and cathode to be reduced by the amount not needed to disrupt the order of the dipoles of the particles of the fluid due to the voltage pulses.

In this respect, it is of advantage if particles are at least approximately linearized in order to facilitate their orientation in the electric field between the anode and cathode.

It is of advantage to use high-energy, monochromatic radiation for orientation purposes, which may be a laser radiation in particular, because the energy needed for orientation purposes can be adapted very selectively to the respective molecule of the fluid and the energy which needs to be transmitted in order to induce various vibration and rotation states.

In one embodiment of the method, the fluid is fed through a circuit, making it possible to operate in a closed system, thereby gaining specific advantages in terms of a chemically treated fluid, in particular as regards the very basic base.

The fluid may be fed into a heat exchanger after the heat generator, in which case this heat exchanger may be provided in the form of a radiator of a room heating system in one embodiment, which is conducive to a heat transfer from the fluid to a carrier medium based on a large surface area.

The pulse generator may be of an electromechanical design, in particular may comprise an electric motor, at least one voltage generator and at least one pump, in particular a hydraulic pump, on a common shaft, the latter being very robust so that it can operate under extreme conditions.

Alternatively, the pulse generator may be of an electronic design, in which case it may specifically comprise at least a transformer, optionally at least a rectifier for situations where alternating voltage is fed in, at least one IGPT and at least one capacitor, and this pulse generator may be of a very compact design and is therefore particularly suitable for small systems. It is also possible to achieve very rapid switching operations, thus leading to a high degree of uniformity.

In order to miniaturize the heat generator still further, the electronic pulse generator may be provided, at least for the most, in the form of a board with appropriate semiconductor modules.

The pulse generator may co-operate with at least one control and/or regulating module for controlling and/or regulating a temperature of the fluid and/or a pulse width and/or pulse duration and/or a pulse frequency, in which case the accuracy of the method can be further enhanced, especially if it is operated using the resonance of the particles, and it is also possible for the method to be controlled so that the heat drawn off, e.g. for heating a room, is not too high, thereby ultimately at least optimizing the consumption of primary energy but preferably also enabling it to be minimized.

The housing casing may also be cylindrical in shape with a view to minimizing losses occurring due to flow resistance as far as possible.

It may be possible to remove the housing base and/or the housing cover from the housing, and in particular they may be fitted on or pushed into the housing, not only affording access to the anode and cathode chamber in the heat generator but also so that the heat generator can also be designed for retrofitting in an existing system, in which case a height compensation can be achieved by using housing bases and/or housing covers of different heights.

It is also of advantage if at least one inlet orifice for the fluid is provided in the housing base, in particular axially, and/or if at least one outlet orifice is provided in the housing cover, likewise axially in particular, and it is of particular advantage if the inlet orifice and the outlet orifice are disposed coaxially with one another because heat losses that would otherwise occur can be reduced or avoided, thereby increasing the energy efficiency of the system. i.e. the heat generator.

Furthermore, the distance between the at least one anode and the at least one cathode may be variable and preferably steplessly adjustable, for example by means of an appropriate screw adjustment, because this will enable the heat generator to be used more universally, given that, depending on the fluid used or depending on the overall design of a system in which the heat generator is operated, this distance, which will be referred to as the dielectric clearance within the meaning of the invention, can be optimized without the need for additional design features.

To enable the distance between the at least one anode and the at least one cathode to be adjusted, the at least one anode and/or the at least one cathode is retained by means of an adjusting mechanism.

This adjusting mechanism is preferably made from a dielectric material in order to prevent energy losses which would otherwise occur due to energy being transmitted into this adjusting mechanism.

The at least one anode or the at least one cathode may at least partially surround the adjusting mechanism in order to keep the anode chamber and cathode chamber as small as possible whilst simultaneously affording sufficient height adjustability and providing a sufficiently large surface of the anode and cathode.

It is of advantage if the adjusting mechanism can be screwed into the housing cover and/or into the housing base and if it is displaceably retained in the housing cover or in the housing base, because this offers a particularly simple design feature for permitting displaceability because only the adjusting mechanism itself needs to be of a height-adjustable design rather than having to adjust a part on it by means of an appropriate mechanism.

The adjusting mechanism may be disposed after the inlet orifice for the fluid in the flow direction of the fluid, in which case it is particular advantage if the inlet orifice is disposed in the adjusting mechanism because this will enable the manufacturing costs of the heat generator to be reduced due to a reduction in the number of individual components, and the volume in the heat generator can also be kept as small as possible, thereby in turn reducing the energy consumption needed to heat the fluid.

However, it would also be possible to provide at least one radially disposed orifice in the adjusting mechanism for discharging the fluid into the anode chamber in the region of the at least one anode, thereby generating a cross-flow in the region of the dielectric clearance—transversely to the axis of the heat generator—so that the fluid enters transversely with respect to the electric field formed between the anode and cathode and therefore has to travel the longest possible path in the electric field. To make it easier to adjust this distance between the anode and cathode, in particular to adjust it manually, it is of advantage if the adjusting mechanism projects outside the housing through the housing cover or through the housing base.

As mentioned above, a dielectric element may be disposed between the at least one anode and the at least one cathode.

This dielectric element may be provided in the form of a deflector element for the fluid in order to achieve said cross-flow, and in particular may project radially through the radially disposed orifices in the adjusting mechanism.

Several heat generators may be connected in series in the heating system proposed by the invention in order to increase the heat output, in which case, especially in the embodiment of the heating system based on a resonant circuit—resonant circuit, the expression serial connection should be understood as meaning that a standing wave is formed in the fluid—by reducing the primary energy needed—by contrast with parallel operation—thereby enabling the efficiency level in the heating system to be further increased.

The heat exchanger of the heating system may be provided in the form of a solar module, thereby resulting in a particularly effective output of thermal energy, e.g. for heating a room.

However, this heat exchanger may also be provided in the form of a conventional radiator, in which case this heating system may be designed as a small, stationary system, for example intended for one room only.

In this instance, however, it is of advantage if the heating is provided in the form of a heating panel, thereby making transmission of the heat into the room more effective.

However, another option would be for the heating system to be designed as a general central heating system.

To provide a clearer understanding, the invention will be explained in more detail below with reference to the appended drawings.

Figure 2:
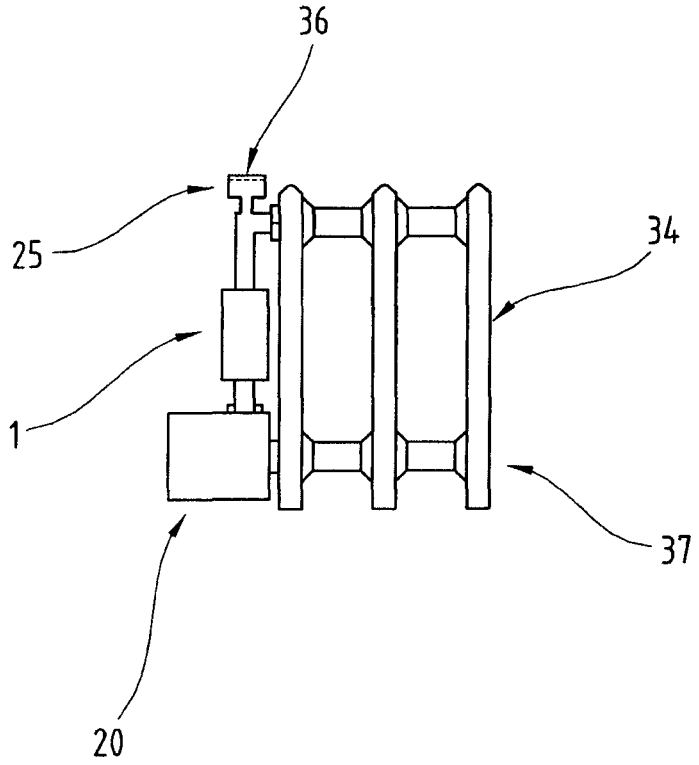
Figure 3:
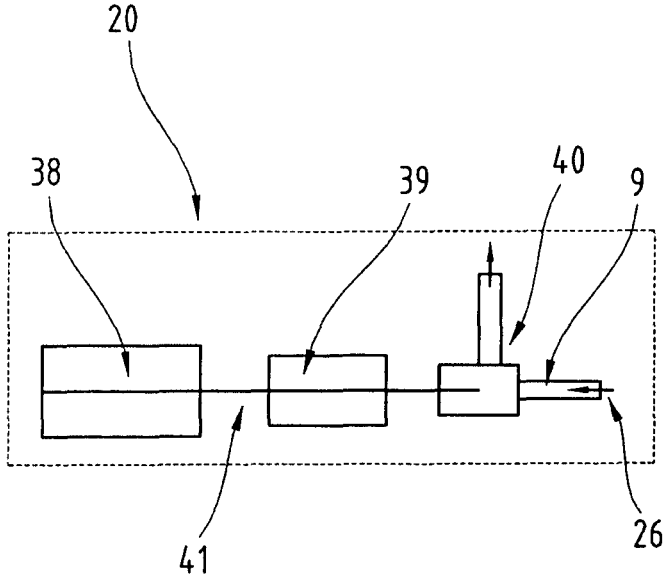
Figure 4:
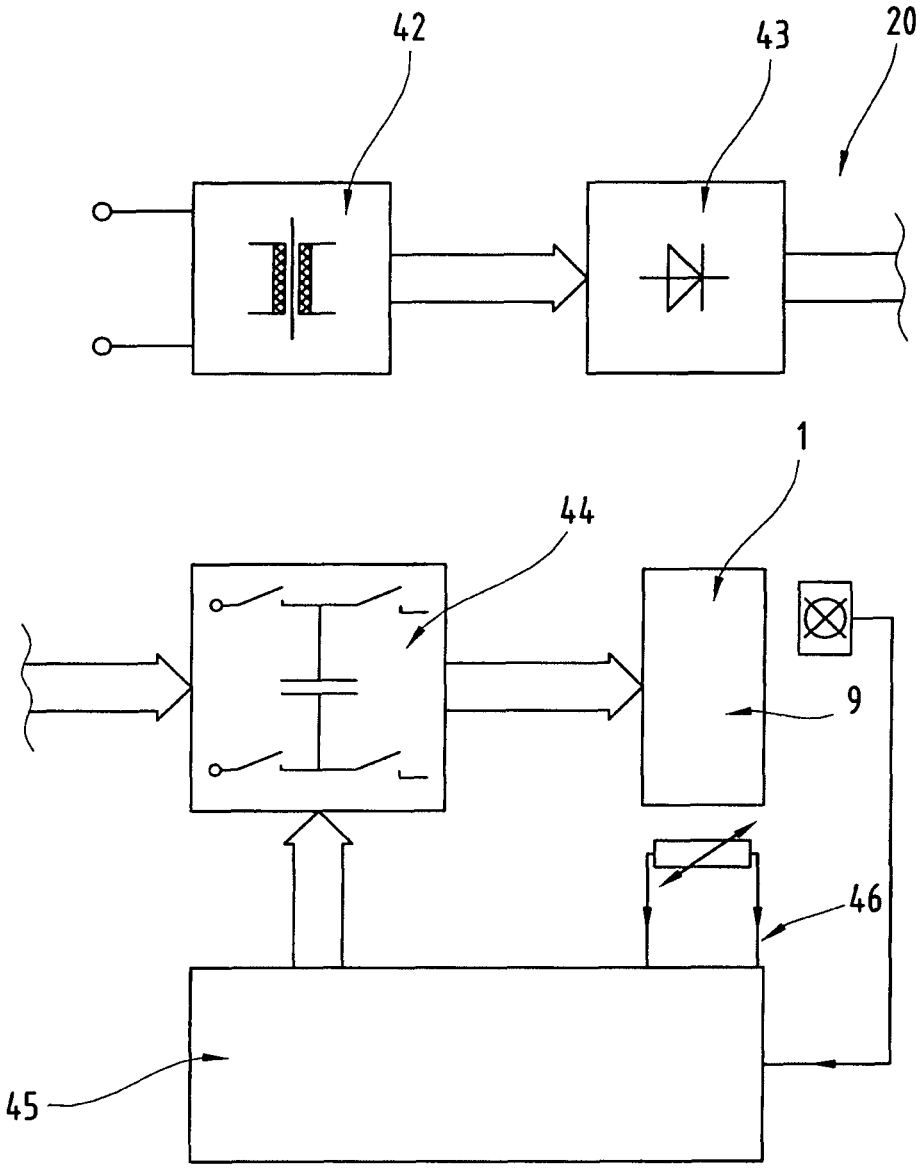

The drawings are highly schematic, simplified diagrams illustrating the following:

FIG. 1 an embodiment of the heat generator proposed by the invention;

FIG. 2 the disposition of the heat generator in a small heating system with a conventional radiator;

FIG. 3 the design of an electromechanical pulse generator;

FIG. 4 a block diagram of an electronic pulse generator.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc. relate to the drawing specifically being described and can be transposed in terms of meaning to a new position when another position is being described. Individual features or combinations of features from the different embodiments illustrated and described may be construed as independent inventive solutions or solutions proposed by the invention in their own right.

FIG. 1 illustrates a heat generator 1 proposed by the invention. It comprises a housing 2 with a housing casing 3 as well as a housing base 4 and a housing cover 5. The housing 2, i.e. the housing casing 3 and/or the housing base 4 and/or the housing cover 5 may be made from a dielectric material, for example from plastics, such as PE, PP, PVC, PS, Plexiglas etc.

As illustrated in FIG. 1, both the housing base 4 and the housing cover 5 are screwed into the housing casing 3 by means of a respective internal thread—each thread 6 co-operates with one of the two respective end regions 7, 8 of the housing casing 3—and a co-operating external thread on the housing base 4 and on the housing cover, so that the housing base 4 and the housing cover 5 can be fitted in the housing casing 3 and removed from it. Instead of the screw connections, it would naturally also be possible to enable them to be removed by a system whereby the housing base 4 or the housing cover 5 are merely slid into the housing casing 3, although if opting for this embodiment, care should be taken to ensure that the system is adequately sealed, e.g. by providing sealing rings or such like, for example O-rings. In addition, it is also possible for the housing base 4 and/or the housing cover 5 to be mounted on the housing casing 3 by a press-fit seating. Another option would be for only the housing base 4 or only the housing cover 5 to be designed to be removed from the housing casing 3.

In the embodiment of the heat generator 1 illustrated in FIG. 1, the housing 2 is of a cylindrical shape. However, it would naturally also be possible for the housing 2 to be of any other three-dimensional shapes, such as cuboid, etc., for example—although the cylindrical design reduces flow resistance as a fluid 9 is conveyed through the heat generator 1.

In the embodiment based on a cylinder illustrated in FIG. 1, the housing base 4 has a cut-out along the longitudinal mid-axis 10, e.g. in the form of a bore, which serves as an inlet orifice 11 for the fluid 9 into the heat generator 1, i.e. a reaction chamber 12 of the heat generator 1.

The housing cover 5 is also provided with an orifice 13 in the form of an axial bore to ensure that the fluid 9 is discharged from the reaction chamber 12.

However, both the inlet orifice and the outlet orifice may be disposed at a different point on the heat generator 1 in the housing 2, for example in the housing casing 3 or radially in the housing base 4 or housing cover 5, so that a tangential flow can be imparted to the fluid 9 as it enters, should this be necessary in order to generate heat.

Optionally, it would also be possible to provide more than one inlet orifice or more than one outlet orifice.

Disposed in the reaction chamber 12 is at least one anode 14 in an anode chamber 15 and at least one cathode 16 in a cathode chamber 17. This being the case, the at least one anode 14 is connected to a positive pole 18 and the at least one cathode 16 is connected to a negative pole 19 of a pulse generator 20.

As illustrated in the case of the embodiment shown in FIG. 1, the anode 14 is spaced apart from the housing base 4 in the reaction chamber 12. To make it easier to obtain this spacing, a dome-shaped seating 21 is provided on the housing base 4 in the region of the orifice 11, in other words the inlet orifice for the fluid 9 into the reaction chamber 12, which can be used as a height-adjusting mechanism for the at least one anode 14. In particular, this seating 21 is in turn of a rotationally symmetrical, bolt-shaped design and is retained in a central bore 22 in the housing base 4.

However, this seating 21 may be of any other geometric shape, for example of a prism-type shape, in which case this bore 22 may be designed to match the external periphery of the seating 21.

Another option is one whereby this seating 21 does not project through the housing base 4 but is seated on it, e.g. is bonded to it or connected to the housing base 4 by some other type of connection means, such as welding for example. In this particular example of an embodiment, this seating 21 is provided with an external thread 23 which locates in an internal thread 24 of the bore 22. This means that the height of this seating 21 can be adjusted to a certain degree so that a distance 25 between the anode 14 and the cathode 16 can be adjusted.

In addition to the screw-in and screw-out feature of the seating 21, it is also possible to design the latter so that it can be displaced in the bore 22, likewise enabling this distance 25 to be adjusted.

Along the course of the longitudinal mid-axis 10, this seating 21, which is preferably also made from a dielectric material, has an end-to-end orifice 26 which extends not in the direction of the longitudinal axis 10 and is disposed after the orifice 10 in the housing base 4 in the flow direction of the fluid 9 (arrow 26).

In the region of the anode 14, i.e. the anode chamber 15, radial bores 27 are provided in the seating 21, by means of which the fluid 9 is able to enter the reaction chamber 12 so that its flow direction is changed as a result.

To this end, in one embodiment, it is possible for the housing base 4 and the seating 21 to be of an integral design, in which case the ability to adjust the height and hence the adjustability of the distance 25 is achieved by designing the housing base 4 so that it screwed into the housing casing 3.

In the embodiment illustrated as an example in FIG. 1, the anode 14 is cylindrical and partially surrounds the seating 21 starting from a top end region 28 in the direction towards the housing base 4. At the bottom, i.e. in the direction of the housing base 4, the vertical position of the anode 14 may be fixed by an appropriate fixing mechanism 29, e.g. a nut or a circumferentially extending web or such like. In the most basic situation, the anode 14 is removably seated on this fixing mechanism 29 but may naturally also be connected to this fixing mechanism 29.

At the top end region 28, the seating 21 is provided with a disc-shaped element 30, as a result of which the ability of the anode 14 to move upwards, i.e. in the direction towards the housing cover 5, is also restricted. This being the case, this disc-shaped element 30 is preferably of a bigger diameter than the seating 21 and preferably projects radially beyond the anode 14.

It would also naturally be possible for the element 30 to be made in an integral design with the seating 21, in which case the anode 14 may be removably mounted on the seating 21 by the removable fixing mechanism 29, e.g. in the form of a nut.

Disposed after the anode 14 in the flow direction of the fluid 9 (arrow 26) is the cathode 16. In this particular embodiment, it is also cylindrical in shape. The cathode 16 is likewise retained in an axial bore 31 of the housing cover 5, and this axial bore 31 is naturally of a bigger diameter than the orifice 13 through which the fluid 9 is discharged.

This cathode 16 is preferably designed so that it can be screwed into the axial bore 31 or fitted into it. Alternatively, it would naturally also be possible for the cathode 16 to be connected to the housing cover 5 so that it is not able to move.

To enable the fluid 9 to flow out of the reaction chamber 12, the cathode 16 may have a central, end-to-end bore 32 in the flow direction of the fluid 9 (arrow 26) in front of the orifice 13.

At this stage, it should be pointed out that wherever a bore is mentioned in this description, if the objects inserted in them are of different geometries, these bores may generally be termed cut-outs and will have appropriately adapted cross-sections.

Also provided in the housing cover 5 in the flow direction of the fluid 9 (arrow 26) upstream of the axial bore 31 of the cathode 16 is a co-operating bore or cut-out which in turn is of a bigger diameter than the axial bore 31, thus forming the cathode chamber 17 in the region of the cathode 16.

The housing cover 5 preferably projects above the cathode 16 in the direction towards the reaction chamber 12. Naturally, however, it would also be possible to opt for the reverse situation, in which case the cathode 16 projects above the housing cover 5 in the direction towards the reaction chamber or the latter are of the same height.

As mentioned above, several individual anodes 15 and several individual cathodes 16 may be provided in the reaction chamber 12, in which case these may optionally form packets.

Another option is one in which the housing base 4 and/or housing cover 5 are not disposed in an internal bore of the housing casing 3 but conversely, this housing casing 3 is designed to engage externally in the manner of a push-on or screw-on cover 5.

The size of the reaction chamber 12 can be varied, in particular with a view to the desired thermal energy to be generated.

The actual flow rate of the fluid 9 in the reaction chamber 12 can therefore also be influenced.

The housing base 4 and/or the housing cover 5 may have connector-type projections at the outer ends, for example to make it easier to connect the heat generator 1 to a heating circuit or similar. To this end, the connector-type projections of the housing base 4 and the housing cover 5 may be provided with co-operating threads. It would naturally also be possible to use a standard screw fitting with clamping nuts or similar, for example a Dutch screw fitting of the type known from the heating sector.

In one embodiment designed for this purpose, the seating 21 may extend through the housing base 4 and can therefore be operated from outside, i.e. from outside the reaction chamber 12, in order to correct the leveling of the distance 25 between the anode 14 and cathode 16 subsequently or to enable adjustments to be made from outside, for example.

In this respect, it should be pointed out that the movement may naturally be motor-driven rather than taking place manually only, to which end this seating 21 may be provided with a co-operating drive for example. This drive may be of a microelectronic design because the absolute degrees of adjustment are not that great when the heat generator 1 is in operating mode and only minor adjustments are needed, provided the correct distance 25 was already set between the anode 14 and the cathode 16 on initial operation. The intention is merely to compensate for any heat expansion which might occur, so that the efficiency of the heat generator 1 can be further increased or optimized.

Between the anode 14 and the cathode 16, the so-called "dielectric clearance" is formed by the gap defined by the distance 25, in particular the gap between the element 30 and the cathode 16. This element 30 may also be made from a dielectric material, for example from the materials specified above.

The distance 25 between the at least one anode 14 and the at least one cathode 16 may be selected from a range with a lower limit of 0.1 mm and an upper limit of 10 cm or with a lower limit of 0.5 mm and an upper limit of 5 cm, the energy yield being surprisingly high in this range.

Both the anode 14 and the cathode 16 are usually made from a metal material.

FIG. 2 is a schematic illustration of one possible application of the heat generator 1 proposed by the invention. The heat generator 1 is disposed in the flow circuit of a heating system, specifically a radiator 34. The radiator 34 may be made from any material, in particular stainless steel, copper or similar.

Also provided in this flow circuit is the pulse generator 20, which is of an electromechanical design in the case of the embodiment illustrated in FIG. 2 and is disposed as shown in FIG. 3, having an expansion vessel 25 in a conventional manner for reducing any excessive pressures which might occur, and optionally also containing a gas absorber 36. This heating circuit may naturally also be provided with other control units, as will be explained in more detail below with reference to FIG. 4. FIG. 2 is merely intended to illustrate the fact that a heating system 37 of the type proposed by the invention can be kept to a very compact design and is thus particularly suitable for installing in a room subsequently.

FIG. 3 illustrates the design of the electromechanical pulse generator 20 illustrated in FIG. 2. It comprises an electric motor 38, a voltage generator 39 and a pump 40, in particular a hydraulic pump, and these elements of the pulse generator 20 are disposed one after the other in the specified sequence on a common shaft 41. The flow direction of the fluid 9 is again indicated by arrow 26, the flow being generated by the pump 40.

In order to highlight the electromechanical pulse generator 20 illustrated in FIG. 3, FIG. 4 shows the block diagram of an electronic pulse generator 20.

It is preferably of a modular construction, in which case a first energy storage module 42 is provided with a transformer, for example, which is galvanically separated by the ground energy system from electrical energy fed in from the main network or other energy sources, such as accumulators, for example.

In the situation where the supply is based on alternating current, the energy fed in is transformed so as to be ground-free in a rectifier module 43, e.g. with conventional rectifier elements known form the prior art.

Wired to the energy storage module 42 and to the rectifier module 43 is a supply module 44, by means of which the continuous direct voltage is transformed into a pulsed direct voltage ground-free. The pulsing direct voltage is then fed into the heat generator 1, i.e. to its anode 14 and cathode 16, so that these pulses are transmitted by these specially disposed electrodes in the heat generator 1 to the fluid 9.

For control and/or regulation purposes, a regulating and/or control module 45 is provided, comprising individual capacitors, transistors, at least one IGPT, and in one embodiment may be provided in the form of a board. This regulating and/or control module 45 may be used to regulate and/or control pulse widths, pulse durations and repeat frequencies of the pulses, for example. The regulation criterion might be a temperature based on a temperature regulating circuit 46, in which case this temperature regulating circuit will receive its data based on the temperature of the fluid 9, in particular the desired temperature of the fluid 9 in the heating system 37 (FIG. 2). It is possible to provide thermostats as temperature sensors in this system 37, in a manner known per se.

Other regulating criteria might be chemical and physical parameters for example, such as the pH value of the fluid 9 or a pressure or a concentration of a chemical additive to the fluid 9, for example a base.

Accordingly, the pulses can be adjusted both in terms of pulse shape and amplitude, and in particular the steepness of the flanks (dU/dt) of the pulses from the pulse generator 20 can be adjusted or regulated, in particular the rising flank and/or the falling flank. Pulses can therefore be adjusted so that they have steeply rising and flat or softly falling flanks, although rectangular or triangular pulses are also possible.

As mentioned above, this electronic pulse generator 20 may be supplied with primary energy, i.e. electric current, directly from the mains network of the electricity company. However, it is also possible to feed in different signal shapes with different frequencies via an intermediate circuit from any power source, and transistors, etc., of a type known from the prior art may be used in the electronic pulse generator 20 for this purpose in order to obtain the ultimately desired pulse shape.

In order to prevent the pulse generator 20 from overheating, it may be provided with an appropriate cooling module (not illustrated in FIG. 4), for example in the form of cooling ribs, e.g. made from aluminum sections.

The fact that it is possible and of advantage to produce thermal energy using the heat generator 1 proposed by the invention was proven by tests, as will be explained in more detail below. However, the way this actually works has as yet not been clarified and after a brief description of the method sequence, only a theoretical idea of the way it works can be given. However, tests have shown that the level of efficiency in producing electric heating energy can be significantly increased using the heat generator 1.

The operating mode of the heat generator 1 can be summed up as follows. The pulse generator 20 is connected to the supply network, i.e. the power grid. The voltage pulses generated by the latter are transmitted via the anode 14 and the cathode 16 to the fluid 9 in the flow circuit of the heating system 37, where they generate the desired heat in the fluid 9. The fluid 9 is kept moving by means of the pump 40, which may be a component of the electromechanical pulse generator 20 illustrated in FIG. 3 on the one hand or, if using an electronic pulse generator, may be a separate component of the heating system 37. The fluid 9 is preferably directed round a closed circuit through the flow mechanisms of the heating system 37 and thus through the heat generator 1, in particular its reaction chamber 12.

Viewed on a molecular level, the fluid 9 is made up of individual particles of a dipolar character, for example of water molecules, water ions and larger units, so-called clusters, of tetrahedral units if water is used as the fluid 9. These particles therefore pass through the dielectric clearance (term as used within the meaning of the invention) formed between the anode 14 and the cathode 16 or between the element 30 and the cathode 16 and are therefore polarized under the influence of the electric field, in particular the alternating voltage field, which builds up between the anode 14 and the cathode 16 due to the pulses. As this happens, the positive particles are oriented with according to the cathode 16, the negative particles according to the anode 14. The effect of the pulses on such polarized particles destroys the short-range order of the particles—this is the theory of how the subject matter functions, for example chemical bonds within the molecules or cluster links, if the fluid 9 is water for example, or the chemical bond between the hydrogen and oxygen atoms in the water molecules and the hydroxyl ions. Since the chemical bonds between these structures are linearly oriented under the effect of the electric field, the pulse effect on these bonds at a frequency similar to the frequency of their temperature expansions causes these bonds to tear apart. The valent electrons generated as a result, which form bonds of this type, are left with an energy deficit after the particles have been torn apart or the short-range order of the particles has been destroyed. They draw energy from their environment and as they are newly re-combining, that is to say in those periods when there are no pulses, they release it in the form of heat, which is then transmitted to the fluid 9 and heats it. As the fluid 9 then flows through the radiator 34, for example, it heats up and this radiator 34 is able to emit this heat into the air of the room, for example, in other words this radiator 34 functions as a heat exchanger.

At this stage, it should be pointed out that it would also be possible to use other heat exchangers, for example plate heat exchangers with a large surface area, coil heat exchangers, etc., whereby the heat from the primary fluid heated by the heat generator 1 is transmitted to a secondary fluid in a known manner in order to heat homes, industrial plants or similar. Another option is to use solar modules, etc., as heat exchangers. These bigger systems are especially suitable for running central heating systems or generally for heating a substance, and the latter may be solid or fluidized, in other words a liquid or a gas.

It has proved to be of particular advantage if the fluid 9 is displaced with a base so that it has a basic pH value. This being the case, the pH value is selected from a range with a lower limit of 7.1 and an upper limit of 14 or more especially preferred with a lower limit of 9 and an upper limit of 12. Any base may be used in principle to obtain the basic pH value, although more especially preferred are caustic soda, caustic potash, calcium hydroxide or calcium carbonate.

Energy consumption can also be reduced if the fluid is already circulating through the heating system 37 with a certain basic resonance, in which case this basic resonance is by particular preference a resonance vibration, in particular with the voltage pulses. This enables the energy consumption of the primary source to be reduced because particles of the fluid 9 already have a very high energy content and the energy used need only be employed for breaking up the short-range order of the particles.

In terms of pulse frequencies, it has proved to be of particular advantage to opt for frequencies selected from a range with an upper limit of 1000 Hz and a lower limit of 10 Hz, in particular with an upper limit of 750 Hz and a lower limit of 50 Hz, preferably an upper limit of 650 Hz and a lower limit of 75 Hz, as a result of which the pulses are transmitted to the fluid in very rapid succession and the particles do not have the opportunity to convert the transmitted energy at least partially into forms of energy other than the desired thermal energy, such as vibration energies or rotation energies within individual molecules.

The pulse duration may be selected from a range with a lower limit of 0.1 ns and an upper limit of 100 ns, in particular from a range with a lower limit of 0.4 ns und an upper limit of 50 ns, preferably from a range with a lower limit of 0.7 ns and an upper limit of 25 ns.

The pulse amplitude may be selected from a range with a lower limit of 1 V and an upper limit of 1500 V, in particular from a range with a lower limit of 50 V and an upper limit of 500 V, preferably from a range with a lower limit of 100 V and an upper limit of 250 V.

As mentioned in the introductory part of the substantive description, it is also of advantage if voltage pulses with a steep rising flank are used so that the energy input takes place rapidly, almost "explosively". These voltage pulses may be rectangular pulses or triangular pulses.

Energy consumption can be reduced if the falling flank of the voltage pulses is flat at least in the bottom third, in other words with an angle of less than 45° with respect to the base.

The table below sets out the results of an experimental measurement of the level of efficiency in terms of energy when generating heat with the heat generator 1 proposed by the invention.

| Characteristic values | 1 | 2 | 3 | Mean |
|---|---|---|---|---|
| Mass m of the solution, having passed through the cell, kg. | 0.138 | 0.154 | 0.392 | 0.228 |
| Temperature of the solution entering the cell $t_1$, degrees. | 21 | 21 | 22 | 21.33 |
| Temperature of the solution leaving the cell $t_2$, degrees. | 71 | 71 | 75 | 72.33 |
| Solution temperature difference $\Delta t = t_2 - t_1$, degrees | 50 | 50 | 53 | 51 |
| Duration of the experiment $\Delta\tau$, sec. | 300 | 300 | 300 | 300 |
| Voltmeter readings V, B | 5.60 | 5.60 | 4.50 | 5.23 |
| Ampere meter readings I, A | 0.51 | 0.51 | 2.00 | 1.00 |
| Consumer of elec. energy as per voltmeter and ampere meter displays $E_1 = I \times V \times \Delta\tau$, kJ | 0.86 | 0.86 | 2.70 | 2.43 |
| Energy of the heated solution, $E_2 = 4, 19 \times m \times \Delta t$, kJ | 27.53 | 30.72 | 87.05 | 48.43 |
| Efficiency level of the cell as per voltmeter and ampere meter displays $K = E_2/E_1$ | 32.01 | 35.70 | 32.24 | 33.32 |

In the view of the applicant, this level of efficiency is achieved due to the fact that the particles satisfy their energy deficit from the physical vacuum once the short-range order is destroyed.

Based on the vibration theory of natural vibrations, it is assumed that, due to the resonance vibration, the destruction of chemical bonds is associated with a reduction of the energy consumption used from a primary energy source, so that the energy needed for this purpose is not drawn from the primary source itself but from the general environment. For the purposes of the test, the behavior of a hydroxyl ion in the heat generator 1 is observed. When the temperature rises, it induces greater molecular vibrations so that distances between protons and electrons are increased to a certain extent. This additional energy requirement may be provided by photons, for example, the energy of which is absorbed by a molecular particle, because ultimately a pulsing process occurs due to the uniform absorption of these photons. In this respect, the pulse frequency is dependent on the rate of the temperature increase of the fluid 9 itself. Current pulses applied to the electrodes orient these hydroxyl particles in such a way that the proton of the hydrogen atom is oriented towards the cathode 16 and the electron of the oxygen atom is oriented in the direction of the anode 14, as already mentioned above. The result of this is that the pulses are oriented in the ion axis. Consequently, it is possible to separate the proton of the hydrogen atom or the entire hydrogen, in other words the proton with its electrons, thereby leaving the nitrogen atom behind. The proton then migrates towards the cathode 16 and hydrogen is formed as the electron is discharged. If the current density at the cathode surface is high, the concentration of hydrogen atoms rises and a plasma is formed, although it is very unstable. In order to prevent the plasma from forming, the method is controlled in such a way that the hydrogen atom does not reach the area of the cathode 16 itself but remains between the anode 14 and cathode 16. When voltage pulses are then applied to the hydroxyl ion, the hydrogen atom is separated in turn so that the electron of the oxygen atom or the electron of the hydrogen atom is released by resonance separation and the bond is ultimately broken, leaving an energy deficit corresponding to the bonding energy. This energy deficit is filled by energy from the environment. Since the method is also run in darkness, it is not or not exclusively photons that are responsible for picking up the energy but, in the view of the applicant, quantities of energy are absorbed from the physical vacuum. Due to the subsequent re-combination of the bond, this surplus energy is released and thus converted in the form of heat, which is transmitted to the fluid 9 accompanied by the emission of heat photons. This being the case, the energy is dependent on the shell of the atomic structure, i.e. the electron shell of an atom, from which these heat photons originate. This can be used to structure the process so that infrared heat photons are released. The physical vacuum is characterized by harmonic natural vibrations, and matter vibrates at the lowest level in energy terms. The frequency spectrum of the natural vibrations of the vacuum thus comprises many magnitudes and is logarithmically-hyperbolically fractally structured so that the correct vibration for satisfying the energy deficit is available with a very high degree of probability. The scale invariance of the natural vibrations of the vacuum causes compression and decompression tendencies to recur in the physical vacuum in scales whose logarithmic distance is constant. Accordingly, the formation of compressed or decompressed material structures is promoted depending on the scale. As a result, it is possible that the heat generator 1 proposed by the invention uses this vacuum resonance and the efficiency of the heat-generating process is improved as a result.

The method proposed by the invention may also be more efficiently configured if the particles are already pre-oriented prior to entering the heat generator 1, in other words pre-polarized in a specific way, so that the energy take-up for this polarization of the particles of the fluid 9 in the heat generator 1 is dispensed with. This orientation may be achieved by high-energy, monochromatic radiation, for example, in particular laser radiation. This being the case, it is of advantage if the particles of the fluid 9 are approximately linearized.

It is also of advantage if a "laser shower" is used as a means of introducing the high-energy, monochromatic radiation for orienting the particles of the fluid 9, this "shower" merely causing a large surface of the fluid 9 or a large surface-area distribution of it, thereby enabling this method step to be configured in a very efficient way.

Although it has been mentioned at several points that the heating system 37 or heat generator 1 proposed by the invention may be used to heat homes, this is naturally not intended to restrict the invention in any way, and it may naturally be employed generally as a means of generating heat, irrespective of the purpose of this heat. One way of optionally increasing the heat output is to connect several generators one after the other, in other words in series, in the heating system. The embodiments illustrated as examples represent possible design variants of the heat generator 1 and the heating system 37, and it should be pointed out at this stage that the invention is not specifically limited to the design variants specifically illustrated, and instead the individual design variants may be used in different combinations with one another and these possible variations lie within the reach of the person skilled in this technical field given the disclosed technical teaching. Accordingly, all conceivable design variants which can be obtained by combining individual details of the design variants described and illustrated are possible and fall within the scope of the invention.

For the sake of good order, finally, it should be pointed out that, in order to provide a clearer understanding of the heat generator 1, it and its constituent parts are illustrated to a certain extent out of scale and/or on an enlarged scale and/or on a reduced scale.

The objective underlying the independent inventive solutions may be found in the description.

Above all, the individual embodiments of the subject matter illustrated in FIGS. 1; 2, 3; 4 constitute independent solutions proposed by the invention in their own right. The objectives and associated solutions proposed by the invention may be found in the detailed descriptions of these drawings.

| List of reference numbers | |
|---|---|
| 1 | Heat generator |
| 2 | Housing |
| 3 | Housing casing |
| 4 | Housing base |
| 5 | Housing cover |
| 6 | Thread |
| 7 | End region |
| 8 | End region |

-continued

| List of reference numbers | |
|---|---|
| 9 | Fluid |
| 10 | Longitudinal mid-axis |
| 11 | Orifice |
| 12 | Reaction chamber |
| 13 | Orifice |
| 14 | Anode |
| 15 | Anode chamber |
| 16 | Cathode |
| 17 | Cathode chamber |
| 18 | Positive pole |
| 19 | Negative pole |
| 20 | Pulse generator |
| 21 | Seating |
| 22 | Bore |
| 23 | External thread |
| 24 | Internal thread |
| 25 | Distance |
| 26 | Arrow |
| 27 | Radial bore |
| 28 | End region |
| 29 | Fixing mechanism |
| 30 | Element |
| 31 | Axial bore |
| 32 | Bore |
| 33 | Bore |
| 34 | Radiator |
| 35 | Expansion vessel |
| 36 | Gas absorber |
| 37 | Heating system |
| 38 | Electric motor |
| 39 | Voltage generator |
| 40 | Pump |
| 41 | Shaft |
| 42 | Energy storage module |
| 43 | Rectifier module |
| 44 | Supply module |
| 45 | Control module |
| 46 | Temperature regulating circuit |

The invention claimed is:

1. Method of heating a fluid containing dipolar particles, such as molecules or clusters of molecules, whereby the fluid is exposed to an electric field in a heat generator and its particles are oriented according to their charge as a result, and the particles are additionally subjected to voltage pulses, causing the short-range order of the particles to be destroyed, and the particles of the fluid may be displaced in a resonance vibration by means of the voltage pulses, after which the short-range order can be re-combined in pulse pauses or externally to the heat generator, thereby releasing or generating thermal energy, wherein the heat generator includes a housing made from a dielectric material, the housing comprising a housing casing, a housing base and a housing cover, with at least one inlet orifice and at least one outlet orifice for the fluid, and at least one anode and at least one cathode are disposed at a distance from one another in the housing, wherein the at least one anode and the at least one cathode are each electrically connected to a pole of at least one pulse generator, wherein the distance between the at least one anode and the at least one cathode is variable, wherein in order to set the distance between the at least one anode and the at least one cathode, the at least one anode and/or at least one cathode is retained by an adjusting mechanism, and wherein at least one radially disposed orifice is provided in the adjusting mechanism for discharging the fluid to an anode chamber in the region of the at least one anode.

2. Method according to claim 1, wherein voltage pulses with a steep rising flank are used.

3. Method according to claim 2, wherein at least approximately rectangular pulses are used.

4. Method according to claim 2, wherein at least approximately triangular pulses are used.

5. Method according to claim 1, wherein voltage pulses with a flat falling flank at least in the bottom third are used.

6. Method according to claim 1, wherein water is used as the fluid.

7. Method according to claim 6, wherein the water is displaced with a lye.

8. Method according to claim 7, wherein the lye is selected from a group comprising caustic soda, caustic potash, calcium hydroxide, calcium carbonate.

9. Method according to claim 1, wherein the fluid is used at a pH value selected from a range with a lower limit of 7.1 and an upper limit of 14.

10. Method according to claim 9, wherein the fluid is used at a pH value selected from a range with a lower limit of 9 and an upper limit of 12.

11. Method according to claim 1, wherein the particles of the fluid are pre-ordered with the aid of energy radiation prior to entering the generator.

12. Method according to claim 11, wherein the particles of the fluid are at least approximately linearized.

13. Method according to claim 11, wherein a high-energy monochromatic radiation is used as the energy radiation.

14. Method according to claim 13, wherein laser radiation is used as the high-energy, monochromatic radiation.

15. Method according to claim 1, wherein the fluid is fed through a circuit.

16. Method according to claim 1, wherein the fluid is fed to a heat exchanger after the heat generator.

17. Method according to claim 16, wherein a radiator for heating a room is used as the heat exchanger.

18. Heat generator for heating a fluid, with a housing made from a dielectric material, the housing comprising a housing casing, a housing base and a housing cover, with at least one inlet orifice and at least one outlet orifice for the fluid, and at least one anode and at least one cathode are disposed at a distance from one another in the housing, wherein the at least one anode and the at least one cathode are each electrically connected to a pole of at least one pulse generator, wherein the distance between the at least one anode and the at least one cathode is variable, wherein in order to set the distance between the at least one anode and the at least one cathode, the at least one anode and/or at least one cathode is retained by an adjusting mechanism, and wherein at least one radially disposed orifice is provided in the adjusting mechanism for discharging the fluid to an anode chamber in the region of the at least one anode.

19. Heat generator according to claim 18, wherein the pulse generator is of an electromechanical design.

20. Heat generator according to claim 19, wherein the electromechanical pulse generator comprises at least one electric motor, at least one voltage generator and at least one pump on a common shaft.

21. Heat generator according to claim 18, wherein the pulse generator is of an electronic design.

22. Heat generator according to claim 21, wherein the electronic pulse generator comprises at least one transformer, at least one IGPT and at least one capacitor.

23. Heat generator according to claim 21, wherein the electronic pulse generator comprises a board.

24. Heat generator according to claim 18, wherein the pulse generator co-operates with at least one regulating and/or control module for controlling and/or regulating a temperature of the fluid and/or a pulse width and/or a pulse duration and/or a pulse frequency.

25. Heat generator according to claim 18, wherein the housing casing is cylindrical in shape.

26. Heat generator according to claim 18, wherein the housing base and/or the housing cover is designed to be removable from the housing casing.

27. Heat generator according to claim 26, wherein the housing base and/or the housing cover is designed to be fitted in the housing casing.

28. Heat generator according to claim 26, wherein the housing base and/or the housing cover is designed to be screwed into the housing casing.

29. Heat generator according to claim 18, wherein the inlet orifice is disposed in the housing base.

30. Heat generator according to claim 18, wherein the outlet orifice is disposed in the housing cover.

31. Heat generator according to claim 18, wherein the distance between the at least one anode and the at least one cathode is steplessly adjustable.

32. Heat generator according to claim 18, wherein the adjusting mechanism is made from a dielectric material.

33. Heat generator according to claim 18, wherein the at least one anode or the at least one cathode at least partially surrounds the adjusting mechanism.

34. Heat generator according to claim 18, wherein the adjusting mechanism can be screwed into the housing cover or into the housing base.

35. Heat generator according to claim 18, wherein the adjusting mechanism is retained in the housing cover or in the housing base so as to be displaceable.

36. Heat generator according to claim 18, wherein the adjusting mechanism is disposed after the inlet orifice for the fluid in the flow direction of the fluid.

37. Heat generator according to claim 18, wherein the inlet orifice is disposed in the adjusting mechanism.

38. Heat generator according to claim 18, wherein the inlet orifice and/or outlet orifice for the fluid is disposed axially in the housing.

39. Heat generator according to claim 18, wherein the adjusting mechanism projects outside of the housing beyond the housing cover or housing base.

40. Heat generator according to claim 18, wherein the dielectric material is provided in the form of a deflector element for the fluid.

41. Heating system comprising at least one conveying device for a first fluid, at least one heat generator for heating the fluid, and at least one heat exchanger in which the heat generated by the fluid is transmitted to another fluid, wherein the at least one heat generator is of the type according to claim 18.

42. Heating system according to claim 41, wherein several heat generators are connected in series.

43. Heating system according to claim 41, wherein the heat exchanger is provided in the form of a solar module.

44. Heating system according to claim 41, wherein the heat exchanger is provided in the form of a radiator.

45. Heating system according to claim 44, wherein the radiator is provided in the form of a heating panel.

46. Heating system according to claim 41, wherein the heating system is configured as a central heating system.

47. Heating system according to claim 41, wherein a device for emitting monochromatic radiation is disposed upstream of the heat generator in the flow direction of the fluid.

48. Heating system according to claim 47, wherein the device for emitting monochromatic radiation is a laser.

49. Heating system according to claim 41, wherein the heating system comprises a resonant circuit.

50. A building comprising a heat generator according to claim 18.

* * * * *

UNITED STATES PATENT AND TRADEMARK OFFICE

CERTIFICATE OF CORRECTION

PATENT NO. : 8,565,588 B2
APPLICATION NO. : 11/918536
DATED : October 22, 2013
INVENTOR(S) : Bierbaumer et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1632 days.

Signed and Sealed this
Fifteenth Day of September, 2015

Michelle K. Lee

Michelle K. Lee
*Director of the United States Patent and Trademark Office*